United States Patent [19]

Gertsch et al.

[11] Patent Number: 4,485,738

[45] Date of Patent: Dec. 4, 1984

[54] METERING BLADE FOR ZONALLY METERING A LIQUID FILM

[75] Inventors: Peter Gertsch, Niederscherli; Robert Imhof, Bern; Andreas Zahnd, Zollikofen, all of Switzerland

[73] Assignee: Maschinenfabrik WIFAG, Switzerland

[21] Appl. No.: 446,698

[22] Filed: Dec. 3, 1982

[30] Foreign Application Priority Data

Dec. 14, 1981 [SE] Sweden ..... 810747/67

[51] Int. Cl.[3] ..... B41F 31/04

[52] U.S. Cl. ..... 101/365; 101/169

[58] Field of Search ..... 101/365, 169, 157; 15/256.51

[56] References Cited

U.S. PATENT DOCUMENTS 2,283,830 5/1942 Taylor ..... 101/365
3,855,927 12/1974 Simeth ..... 101/169 X
4,373,445 2/1983 Kobler ..... 101/157 X

FOREIGN PATENT DOCUMENTS 2305831 8/1974 Fed. Rep. of Germany ..... 101/365
2545737 4/1977 Fed. Rep. of Germany .

*Primary Examiner*—Clifford D. Crowder
*Assistant Examiner*—Charles A. Pearson
*Attorney, Agent, or Firm*—McGlew and Tuttle

[57] ABSTRACT

A metering blade for zonally metering a liquid film comprises a plate body having a working edge usable in an arrangement in which the setting member bears against the plate body and bridges a portion thereof against a rotating roller comprises a blade with a plurality of zonal setting portions of a material capable of being displaced by resilient flection adapted to be arranged adjacent a setting member which includes intermediate portions between a working edge and the opposite edge compensating for the setting wherein the setting portions are at least 3 mm in thickness and each intermediate portion includes a web part having a thickness which is not more than 1/5th the thickness of the setting portion and has a width amounting to at least five times the thickness of the web. The blade has a working edge with a reinforcement adjacent each web.

2 Claims, 4 Drawing Figures

METERING BLADE FOR ZONALLY METERING A LIQUID FILM

FIELD AND BACKGROUND OF THE INVENTION

This invention relates in general to metering blades or doctor blades and in particular to a new useful metering blade which is adapted to be used with a setting member which is adjustably engaged with the blade to urge it into contact with a rotating roller.

A metering or doctor blade of this kind is known from U.S. Pat. No. 2,283,830. This disclosure however, does not reveal the dimensional relationship between the intermediate portions and the thickness of the setting portions, necessary for achieving the objective aimed at. The relatively weak working edges in the intermediate portions are very sensitive to mechanical damage.

SUMMARY OF THE INVENTION

The invention is directed to a blade having well defined dimensional proportions and having zonal portions which can be set absolutely parallel to the doctor axis over the entire setting range, and in which the working edge within the extent of the intermediate portions is protected against mechanical damage.

In accordance with the invention a metering blade comprises a blade body having a holding edge and an opposite working edge and constructed with a plurality of alternate zonal setting portions and intermediate portions between the setting portions, said intermediate portions being of shallow depth such that the thickness of the setting portion is at least 3 mm and the webs forming the intermediate portions have a thickness corresponding at most to 1/5th of the thickness of the setting portion with a longitudinal width amounting at least to five times the thickness of the web portion and wherein the working edge of the blade has a reinforcement adjacent each web.

A further object of the invention is to provide a metering blade which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention is illustrated.

DESCRIPTION OF THE PREFERRED EMBODIMENTS

Figure 1:
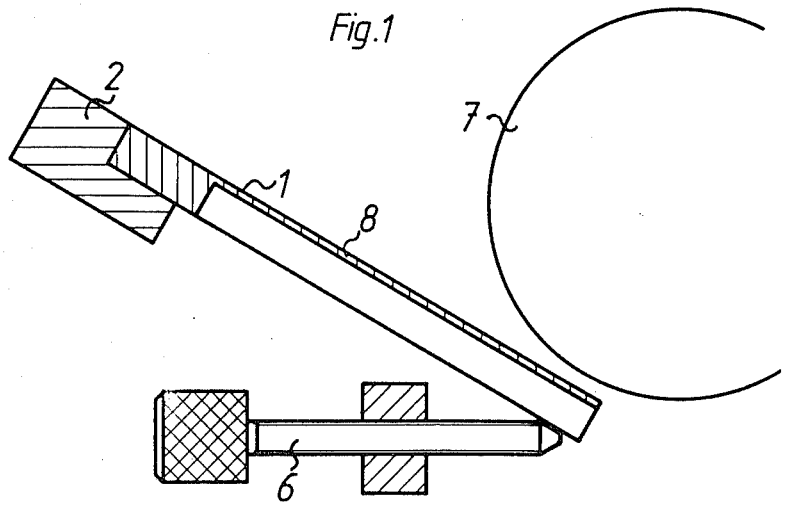
FIG. 1 is a diagrammatical illustration of a metering blade arrangement in the stage of being set relative to a rotating roller.
Figure 2:
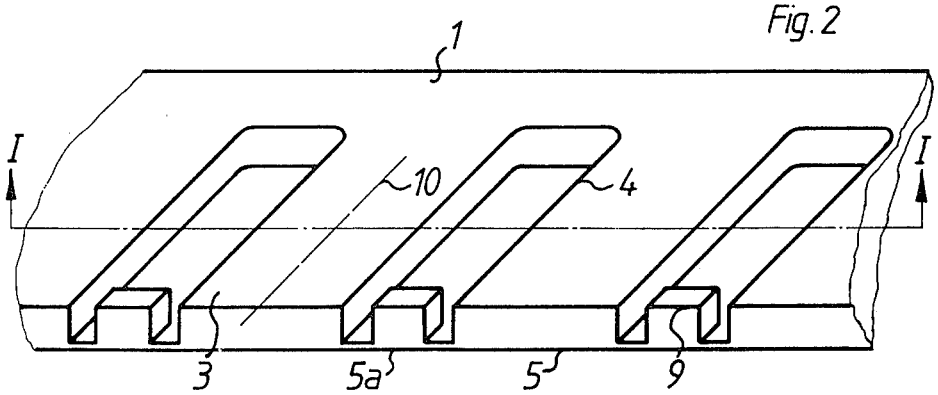
FIG. 2 is a partial top perspective view of a metering blade constructed in accordance with the invention.

Referring to the drawings in particular the invention embodied therein comprises a metering blade generally designated 1 which has a continuous working edge 5, 5*a* and an opposite holding edge which is secured in a blade holder 2 alongside of a rotating roller 7. The working edge 5*a* is urged to a precise metering position in respect to the rotating roller 7 by a setting device 6 which comprises a rotatable member threaded in a support and engageable at its tip with the blade 1.

Figure 3:
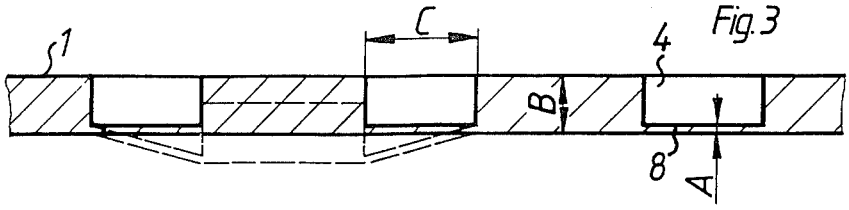
FIG. 3 is a section taken along the line I—I of FIG. 2.

In accordance with the invention the blade 1 comprises a plate body having the working edge 5 with the opposite holding edge 11 and it is composed of a plurality of zonal setting portions 3 arranged in alternate relationship with a plurality of intermediate recessed portions 4. The zonal setting portion 3 is capable of being displaced by resilient flection. The intermediate portions 4 between the setting portion 3 compensate for the setting which is effected by the setting member 6. Portions 4 are elongated in a direction away from edge 5, 5*a*, and rectangular, as shown in FIG. 3. The thickness of each of the setting portions 3 is at least 3 mm and each intermediate portion is formed by at least one flat diaphragm-like web 8 defining the base of each portion which has a thickness generally designated A as shown in FIG. 3 which corresponds at most to 1/5th of the thickness B of the setting portion 3. The width C of the intermediate portion extending in substantially a longitudinal direction amounts to at least five times the thickness A of the web 8. In accordance with another feature of the invention the blade working edge 5*a* is provided with a reinforcement or raised portion 9 adjacent an edge of each web portion and intermediate its width. The raised portion can be rectangular as shown and is spaced from the setting portions 3 on either side.

The metering blade 1 is clamped, in a manner known per se, in the blade holder 2 and subdivided into the zonal setting portions 3, and intermediate portions 4 therebetween which compensate for the set off positions of portions 3. The working edge 5, 5*a* of the blade is continuous. Each zonal portion 3 can be set individually against a roller 7 by means of the setting member 6.

To preserve the mechanical resistance of the sensitive parts 5*a* of the working edge within intermediate portions 4, the reinforcement 9 is provided, formed by unmachined material of the blade 1 which also forms the portions 3.

To prevent dirt from depositing within intermediate portions 4, it is advisable to fill the respective spaces with an elastic material not shown.

In a metering blade manufactured in accordance with the invention, i.e. of a metallic material or a plastic, in one piece or from a compound material, the individual zonal setting portions 3, upon being brought into desired positions by means of setting members 6 which act along lines 10, are displaced absolutely parallel to the axis of roller 7, since the relatively very thin webs 8, of a structure similar to a diaphragm, are not capable of affecting the relatively thick setting portions 3 (see FIG. 3).

Figure 4:
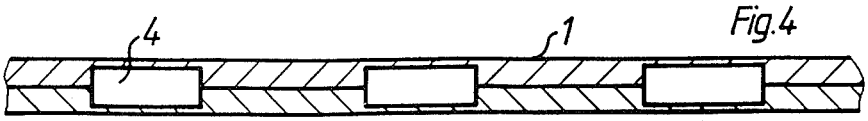
FIG. 4 is a section similar to FIG. 3 of another embodiment of the invention.

An absolutely parallel displacement of setting portions 3 is again insured in an embodiment according to FIG. 4 where two webs, for example, are provided in every intermediate portion 4 one on top and one on the bottom of the blade 1.

While specific embodiments of the invention have been shown and described in detail to illustrate the application of the principles of the invention. It will be understood that the invention may be embodied otherwise without departing from such principles.

What is claimed is:

1. A metering blade for zonally metering a liquid film on a rotatiang roller in inking coating and dampening devices of printing machines which is usable with a displaceable setting member which is adapted to bear against the blade adjacent a working edge thereof to position this edge in relationship to the rotating roller, comprising a blade body (1) having the working edge (5, 5*a*) and an opposite holding edge and having a plurality of alternately arranged resilient setting portions (3) and intermediate portions extending along its length, said setting portions each having a thickness of at least 3 mm, said intermediate portions each including a bottom comprising a thin web (8) having a thickness at most 1/5th the thickness of said setting portions and a width in a longitudinal direction amounting to at least five times the thicknesss of said web, and a reinforcement (9) defined adjacent said working edge intermediate the width of said web, said blade being made of a single piece of metal, said blade body being in the form of a flat plate, said intermediate portions formed as elongated rectangular recesses in a surface of said flat plate adapted to face away from the rotating roller, said setting portions being rectangular in said surface and being defined between said recesses and having a width equal to the width of said reinforcement for each intermediate portion, each reinforcement comprising a rectangular raised portion on said web of each intermediate portion and having rectangular sides spaced away from a setting portion on each side and a rectangular end extending to said working edge, a length of said sides of said reinforcement being less than a width of said recess between a setting portion on each side of said recess.

2. A metering blade comprising:

a flat plate (1) having a working edge (5,5*a*) and an opposite holding edge;

said flat) plate having a thickness of at least 3 mm, with a first surface adapted to face a rotating roller for metering a liquid film on the rotating roller, and an opposite second surface;

said flat plate including, on said second surface thereof, a plurality of spaced apart rectangular recesses (4) defining setting portions (3) therebetween and having a thin web floor (8) extending across said first surface, each recess being elongated and extending away from said working edge (5,5*a*);

a raised reinforcement portion (9) having rectangular sides and disposed in each recess and having a thickness equal to each setting portion and spaced from each setting portion so that a portion of said web in each recess extends between said reinforcement portion and each setting portion, each reinforcment portion having a top surface lying in said second surface of said flat plate and an outer side extending to a portion (5*a*) of said working edge, each reinforcement portion having a length in a direction of elongation of each recess which is less than a width of each recess perpendicular to said direction; and said web having a thickness at most 1/5th the thickness of said setting portions and a width of each recess being at least five times the thickness of said web;

said flat plate with said recesses, setting portions, reinforcement portions and webs being made of a single piece of material.

* * * * *